United States Patent [19]

Paul et al.

[11] 4,412,412

[45] Nov. 1, 1983

[54] LOADING DEVICE FOR FALSE-TWIST APPARATUS

[75] Inventors: Günter Paul, Hammelburg; Kirit Patel, Elfershausen; Günter Schmitt, Hammelburg, all of Fed. Rep. of Germany

[73] Assignee: Fag Kugelfischer Georg Schäfer & Co., Schweinfurt, Fed. Rep. of Germany

[21] Appl. No.: 370,052

[22] Filed: Apr. 20, 1982

Related U.S. Application Data

[63] Continuation-in-part of Ser. No. 182,649, Aug. 29, 1980, abandoned.

[30] Foreign Application Priority Data

Sep. 1, 1979 [DE] Fed. Rep. of Germany ..... 2935380

[51] Int. Cl.[3] ..... D01H 15/00; D02G 1/08

[52] U.S. Cl. ..... 57/280; 57/339

[58] Field of Search ..... 57/279, 280, 338, 339, 57/343, 352

[56] References Cited

U.S. PATENT DOCUMENTS

| | | | |
|---|---|---|---|
| 3,287,890 | 11/1966 | McIntosh et al. | 57/339 |
| 3,854,276 | 12/1974 | Marzoli | 57/339 |
| 3,911,661 | 10/1975 | Naylor | 57/339 |
| 3,942,313 | 3/1976 | Gassner et al. | 57/339 |
| 4,027,467 | 6/1977 | Smith | 57/352 X |
| 4,149,366 | 4/1979 | Bass et al. | 57/339 X |
| 4,226,080 | 10/1980 | Bieber et al. | 57/339 |
| 4,235,071 | 11/1980 | Dillon | 57/280 |

*Primary Examiner*—John Petrakes

*Attorney, Agent, or Firm*—Karl F. Ross

[57] ABSTRACT

A thread-loading device is used in combination with a false-twist apparatus having at least one frame element having an abutment surface turned away from the yarn-twisting region defined by three sets of axially spaced rotatable twisting disks. The thread-loading device has interengaging formations on the frame adjacent the abutment surface and on the support for releasably securing same together. These formations extend radially of the region. Thus the support can be fitted to the frame by being displaced radially toward the region to interfit the formations. A detent is carried in the support and displaceable between a blocking position engaged with the arm in the outer position thereof for preventing movement of the arm relative to the support and a freeing position permitting such movement. Release mechanism linked to the detent has a release element displaceable between a projecting position engageable with and depressable by the abutment surface when the formations are interfitted and a depressed position for displacing the detent into the freeing position only when the release element is in the depressed position. Thus the arm cannot move on the support unless the support is fitted snugly to the frame with the release element depressed by the abutment surface.

9 Claims, 4 Drawing Figures

18
16
17
19
20
14
15
15a
15b
16a
17a
26
23b
27
28
29
30
A
A'
III
11
10
T
Y
12
M

LOADING DEVICE FOR FALSE-TWIST APPARATUS

CROSS REFERENCE TO RELATED APPLICATION

This application is a continuation-in-part of copending patent application Ser. No. 182,649 filed Aug. 29, 1980, now abandoned.

FIELD OF THE INVENTION

The present invention relates to a loading device for a false-twist apparatus. More particularly this invention concerns such a device which threads a yarn into a disk-type false-twist apparatus.

BACKGROUND OF THE INVENTION

A disk-type false-twist apparatus has a frame defining at least three generally parallel and radially spaced axes surounding a central axially extending twisting region. Respective shafts are journaled in the frame for rotation about these axes and respective sets of axially spaced disks are fixed on the shaft and have rims radially overlapping at the twisting region. A yarn to be false-twisted can pass axially along the region in contact with the rims. A drive connected to the shafts permanently connects same together for joint rotation. Thus the yarn passing through the region is false-twisted by the rotating disks.

In the above-cited application a loading device for such an apparatus is described which has a support and means including interengaging formations on the frame and on the support for releasably securing same together. A loading arm is carried on and displaceable relative to the support and has a yarn-pushing tip turned toward and engageable between the disks. This tip is displaceable with the arm between an outer position spaced from the disks and an inner position with the tip and a yarn engaged thereover in the region and axially between the disks. A spring is engaged between the support and the arm for urging same into one of the positions. Normally the system has a stack of such arms extending parallel to each other and jointly movable.

Such an arrangement has been found to be of great assistance in threading a yarn in a false-twist apparatus. A machine operator needs a single such device for the entire battery of false-twisters, which may number as many as 200 in a single battery. The appartus is fitted to the machine to load in a yarn, and a simple one-handed maneuver is all that is then needed to actuate it, leaving the other hand free to pull the filament straight into position between the tips of the arms and the twisting region.

Nonetheless such a machine was found to be at times slightly difficult to use because it was necessary to change grip on the device from that necessary to fit it to the twister and that necessary to actuate it. In addition the known device would occasionally jam or break down.

OBJECTS OF THE INVENTION

It is therefore an object of the present invention to provide an improved threading device for a false-twist apparatus.

Another object is the provision of such a threading device for a false-twist apparatus which overcomes the above-given disadvantages.

A further object is to provide an easy-to-use and convenient threader which can be gripped and held with the same grip during carying, fitting to the twister, and threading of a yarn.

SUMMARY OF THE INVENTION

These objects are attained according to the instant invention in a thread-loading device used in combination with a false-twist apparatus of the type described above, and having at least one frame element having an abutment surface turned away from the region. The thread-loading device of this invention is similar to that described in the parent application, and has interengaging formations on the frame adjacent the abutment surface and on the support for releasably securing same together. These formations extend radially of the region. Thus the support can be fitted to the frame by being displaced radially toward the region to interfit the formations. According to the instant invention a detent is carried in the support and displaceable between a blocking position engaged with the arm in the outer position thereof for preventing movement of the arm relative to the support and a freeing position permitting such movement. Release means is linked to the detent and has a release element displaceable between a projecting position engageable with a depressable by the abutment surface when the formations are interfitted and a depressed position for displacing the detent into the freeing position only when the release element is in the depressed position. Thus the arm cannot move on the support unless the support is fitted snugly to the frame with the release element depressed by the abutment surface.

According to another feature of this invention a plurality of such arms are provided on the support, but the detent is only engageable with one of the arms. The loading device further has a handle interconnecting all of the arms for joint displacement relative to the support so that the device can be manipulated and fitted to the frame by the handle.

With the system of the present invention, therefore, the operator can push against the arm-operating handle to fit the support to the twister frame. Until the support is snugly fitted to the frame, the detent operated by the release means relatively fixes the support, arm, and handle together to allow the entire device to be manipulated by means of this handle, without the support sliding back on the arm when the support is pressed against the frame. It no longer is necessary to grip the device by the support to fit it to the frame, and then switch over to grip the arm-operating handle to operate the device, as this handle is effectively part of the housing until the device is fully fitted to the twister.

According to another feature of this invention the formations include a pin projecting radially from the abutment surface and a complementary recess formed in the support. The frame element itself is a post extending parallel to the axes. A permanent magnet mounted on the support can secure it in place on the frame post which is normally of steel.

The detent is a two-arm lever pivotal on the support about an axis transverse to the arm and having one arm engageable with the release element and another arm lockingly engageable with the arm. In this case the lever is formed with a transversely open notch and the other arm of the detent has a tooth engageable in the notch. In such a system the release element is a pin displaceable parallel to the arm in the support and having an outer end engageable with the abutment surface and an inner end engageable with the one arm of the detent. The holding means includes a spring urging the detent into the freeing position and the release element into the projecting position.

DESCRIPTION OF THE DRAWING

The above and other features and advantages will become more readily apparent from the following, reference being made to the accompanying drawing in which.

SPECIFIC DESCRIPTION

Figures 1, 2:
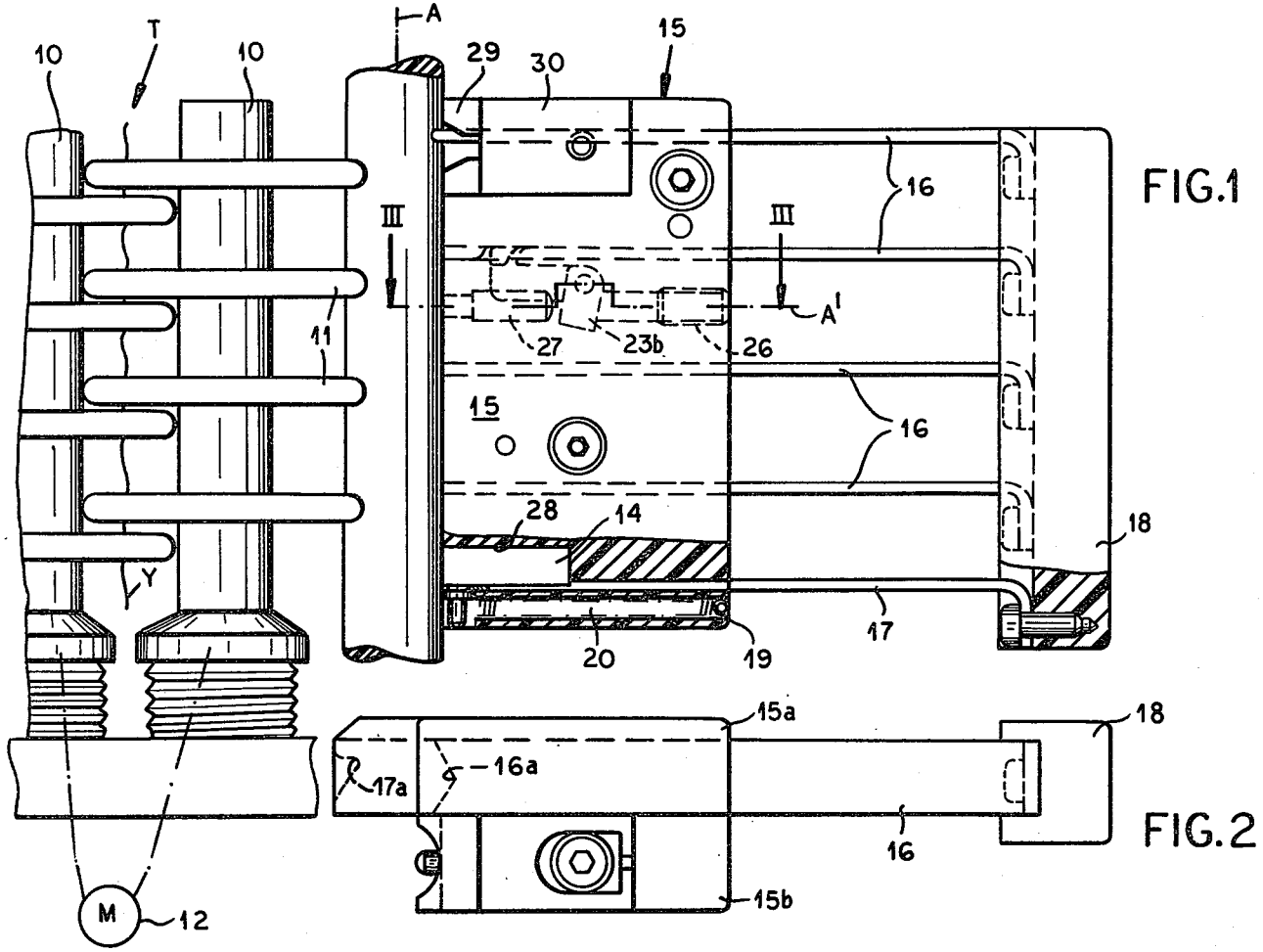
FIG. 1 is a side view partly broken away of the device according to this invention.
FIG. 2 is a top view of the device of FIG. 1.

As seen in the FIG. 1 of drawing, the system of this invention is used in junction with a twister of the type described in the above-cited patent and having three shafts 10 centered on respective parallel axes and carrying respective sets of axially spaced disks 11 that define an axially extending twisting region T. A drive motor 12 is connected to the shafts 10 to rotate the disks 11 codirectionally about the respective shaft axes. A yarn Y extending along the region T will therefore be false twisted as it is contacted by the rims of the disks 11. The twister has a frame including an upright steel rod 13 centered on an axis A adjacent and parallel to the region T and provided with a radially projecting centering formation or pin 14.

As seen in FIGS. 1 and 2 the thread-loading device according to this invention has a support 15 basically constituted as two blocks 15*a* and 15*b* of a durable synthetic resin that are bolted and pinned together. The block 15*a* is formed with five parallel slots closed by the block 15*b* and receiving four short arms 16 and one long arm 17 having bent-down rear ends bolted to a common handle part 18 also formed of a synthetic resin. At its lower end the block 15*a* is formed with a forwardly projecting foot so the longer lower lever 17 is completely protected when retracted as illustrated. The lower portion of the block 15*a* is also formed with a slot 19 receiving a tension spring 20 hooked at its rear end on the block 15*a* and at its front end on the arm 17 to urge it and the arms 16 linked by the handle part 18 to it.

The front ends of the arms 16 and 17 are formed with notches 16*a* and 17*a* for pushing the yarn Y into the region T as is well known. In addition the block 15*b* has a front face 15*c* formed with a cylindrical blind hole 28 in which the pin 14 is snugly engageable and the upper end of the block 15*b* is provided with a fork 29 and with a permanent magnet 30 that center the face 15*c* of the block 15*b* on the rod 13 and hold it there.

Figure 3:
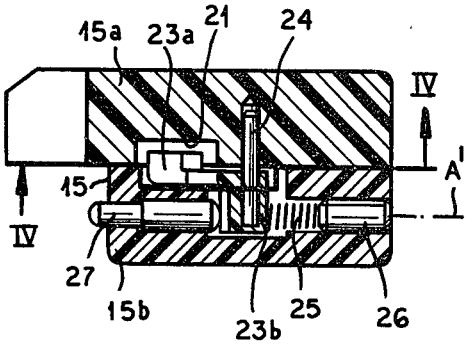
FIG. 3 is a section taken along line III—III of FIG. 1.
Figure 4:
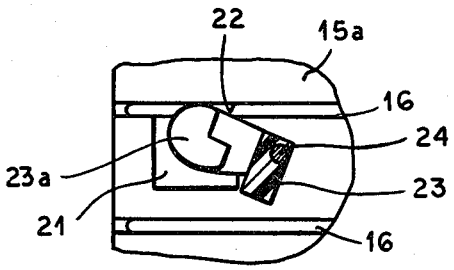
FIG. 4 is a section taken along line IV—IV of FIG. 3.

As better seen in FIGS. 3 and 4 the two blocks form a pocket 21 with which a laterally open notch 22 of one of the arms 16 is aligned in the illustrated inner or retracted position. A two-arm lever detent 23 is carried on a pivot 24 spanning the two blocks 15*a* and 15*b* and has one arm 23*a* formed as a dog or tooth pivotal into the notch 22 to prevent displacement of the arms 16 and 17 toward the region T. The other arm 23*b* of this lever 23 is urged toward the region T by a spring 25 braced against a radially extending set screw 26 and presses against the rear end of a stepped pin 27 that normally projects toward the region T from the front face 15*c* of the block 15*b*. The spring 25 and pin 27 are coaxial to an axis A′ perpendicular to the axis A with the pin 14 is fitted in the recess 28 in the face 15*c* of the block 15*b*.

When the support 15 is engaged with a frame element such as the rod 13 the pin 27 will be depressed, moving it along the axis A′ backwardly away from the region T. This action will pivot the detent 23 counterclockwise about its axis 24 and pull its tooth 23*a* out of the notch 22. Thus the arms 16 and 17 would be free to slide in the direction of axis A′ toward the twisting region T to load the yarn Y.

When, however, the support is not snugly fitted to the rod 13 the spring 27 will push the detent arm 23*b* and the pin 27 so that the latter projects from the face 15*c* and the former pivots clockwise to engage its tooth 23*a* in the notch 22. In this position the arms 16 and 17 cannot slide toward the twisting region and the handle part 18 is fixed relative to the support 15. If the arms 16 are in the outer position, so that the notch 22 is not aligned with the tooth 23*a*, the detent 23 will be prevented from pivoting clockwise by engagement with the underside of the arm 16 so that the force of the spring 25 will not be transmitted through the arm 23*b* to the pin 27. Only when the arm slides back and the notch realigns with the tooth 23*a* will it snap into place and will the pin 27 be pushed out.

Thus the system according to the instant invention allows the device to be carried and manipulated by means of the handle 18. Holding it only by this handle 18 the user can fit the pin 14 to the hole 28 and push the support 15 into the illustrated position. As soon as it is in this position, the detent 23 frees the support 15 for movement relative to the arms 16 and 17 so the device can function normally.

Not only is the system according to this invention convenient in that it eliminates the necessity of changing grips for the operator, who as mentioned above might be working on a batter of 200 or more such twisters, but it also prevents the device from being actuated unless it is perfectly positioned relative to the twisting region T. Poking the steel arms 16 and 17 into this region T when the system is not perfectly aligned could damage the twister and the threader. Such actuation is impossible with the system of this invention.

We claim:

1. In combination with a false-twist apparatus including:

a frame defining at least three generally parallel and radially spaced axes surrounding a central axially extending twisting region and having at least one frame element having an abutment surface turned away from said region;

respective shafts lying on and journaled in said frame for rotation about the respective axes;

respective sets of axially spaced disks fixed on said shaft and having rims radially overlapping at said twisting region, whereby a yarn to be false-twisted can pass axially along said region in contact with said rims; and drive means connected to said shafts for permanently connecting same together for joint rotation, whereby a yarn passing through said region is false-twisted by the rotating disks, a thread-loading device comprising:

a support;

means including interengaging formations on said frame adjacent said abutment surface and on said support for releasably securing same together, said formations extending radially of said region, whereby said support can be fitted to said frame by being displaced radially toward said region to interfit said formations;

a loading arm carried on and displaceable relative to said support and having a yarn-pushing tip turned toward and engageable between said disks, said tip being displaceable with said arm between an outer position spaced from said disks and an inner position with said tip and a yarn engaged thereover in said region and axially between said disks;

means including a spring engaged between said support and said arm for urging same into one of said positions; and a detent carried in said support and displaceable between a blocking position engaged with said arm in said outer position thereof for preventing movement of said arm relative to said support and a freeing position permitting such movement; and release means linked to said detent and having a release element displaceable between a projecting position engageable with and depressable by said abutment surface when said formations are interfitted and a depressed position for displacing said detent into said freeing position only when said release element is in said depressed position, whereby said arm cannot move on said support unless said support is fitted snugly to said frame.

2. The combination defined in claim 1 wherein a plurality of such arms are provided on said support, but said detent is only engageable with one of said arms, said device further comprising a handle interconnecting all of said arms for joint displacement relative to said support, whereby said device can be manipulated and fitted to said frame by said handle.

3. The combination defined in claim 1 wherein said formations include a pin projecting radially from said abutment surface and a complementary recess formed in said support.

4. The combination defined in claim 3 wherein said frame element is a post extending parallel to said axes.

5. The combination defined in claim 1 wherein said detent is a two-arm lever pivotal on said support about an axis transverse to said arm and having one arm engageable with said release element and another arm lockingly engageable with said arm.

6. The combination defined in claim 5 wherein said lever is formed with a transversely open notch and said other arm of said detent has a tooth engageable in said notch.

7. The combination defined in claim 5 wherein said release element is a pin displaceable parallel to said arm in said support and having an outer end engageable with said abutment surface and an inner end engageable with said one arm of said detent.

8. The combination defined in claim 5 wherein said holding means includes a spring urging said detent into said freeing position and said release element into said projecting position.

9. The combination defined in claim 1 wherein said means for securing further includes a permanent magnet carried on said support and having a face engageable with said frame element when said formations are interfitted.

* * * * *